United States Patent [19]

Shelton

[11] 4,350,926

[45] Sep. 21, 1982

[54] HOLLOW BEAM ELECTRON SOURCE

[75] Inventor: Joe Shelton, Huntsville, Ala.

[73] Assignee: The United States of America as represented by the Secretary of the Army, Washington, D.C.

[21] Appl. No.: 172,803

[22] Filed: Jul. 28, 1980

[51] Int. Cl.[3] ..... H01J 29/46; H01J 29/56

[52] U.S. Cl. ..... 313/455; 313/456

[58] Field of Search ..... 313/452, 455, 456

[56] References Cited

U.S. PATENT DOCUMENTS

| | | | |
|---|---|---|---|
| 2,276,806 | 3/1942 | Tonks | 313/455 X |
| 2,791,711 | 5/1957 | Harris | 313/452 |
| 2,869,021 | 1/1959 | Currie | 313/456 X |
| 2,887,609 | 5/1959 | Dodds | 313/455 X |
| 2,916,666 | 12/1959 | Hall | 313/455 X |
| 2,936,396 | 5/1960 | Currie | 313/455 X |
| 2,967,260 | 1/1961 | Eitel | 313/456 X |
| 3,745,402 | 7/1973 | Shelton et al. | 313/309 X |

*Primary Examiner*—Robert Segal

*Attorney, Agent, or Firm*—Nathan Edelberg; Robert P. Gibson; Robert C. Sims

[57] ABSTRACT

A cold field emitter is placed in special relationship to an anode device having a hole in it close to the emitter. A second electrode can be located above the hole in the anode and be a circular shape of lesser diameter than the first anode so as to shape the hollow beam being emitted by the device.

2 Claims, 4 Drawing Figures

HOLLOW BEAM ELECTRON SOURCE

The invention described herein may be manufactured, used, and licensed by or for the Government for governmental purposes without the payment to me of any royalties thereon.

BACKGROUND OF THE INVENTION

Electron devices capable of generating hollow beams of electrons have been used for a number of years for electronic applications such as the traveling wave tubes. While improving the efficiency of the devices, they reached limitations due to physical fabrication problems and total current transport due to low current densities. The device described in this disclosure is many times smaller than conventional hollow beam guns and has a much higher beam current density.

DESCRIPTION OF THE BEST MODE AND PREFERRED EMBODIMENTS

Figure 1:
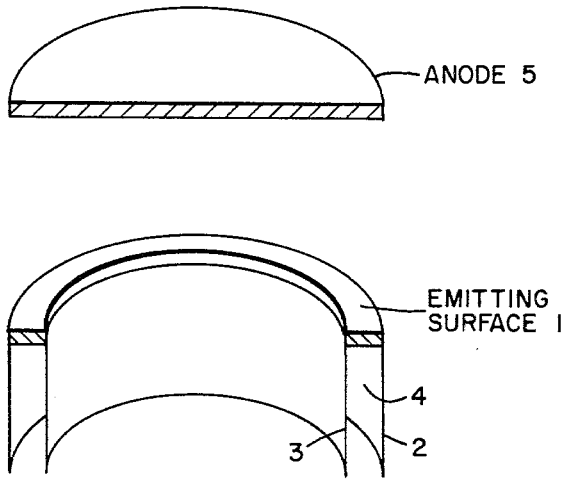
FIG. 1 is a schematic illustration of a hollow beam emitter.

One type of hollow beam emitter is shown in FIG. 1. The actual emitting surface 1 is held in place by two cylinders 2 and 3 which form the heater cavity 4. When the emitting surface 1 is heated to the proper temperature electrons are freed and are pulled to an electrode 5 by the electric field generated when a potential is applied between the anode 5 and emitting surface 1. The beam thickness (the difference in the inside and outside radius) is limited due to fabrication techniques and the requirement for a heater cavity. In addition, barium migration from the emitting surface 1 to the heater cavity walls 2 and 3 usually increases the beam thickness. The current density is limited to the operating characteristics of the material, and is usually less than 5 amperes/cm$^2$.

Figure 2:
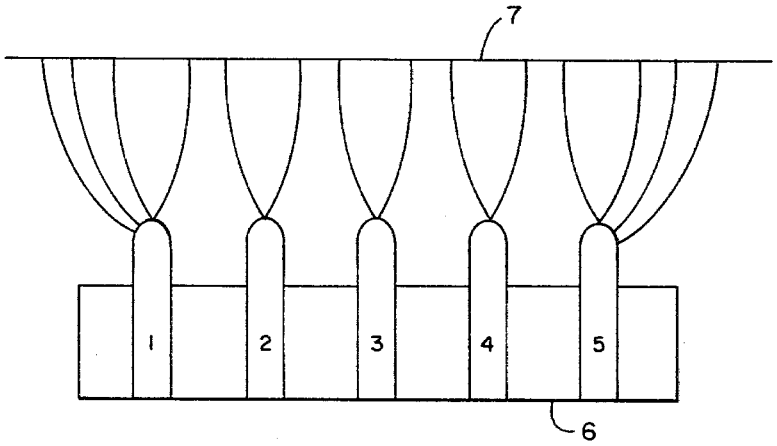
FIG. 2 is a diagrammatic illustration of a basic principle of the present invention.
Figure 3:
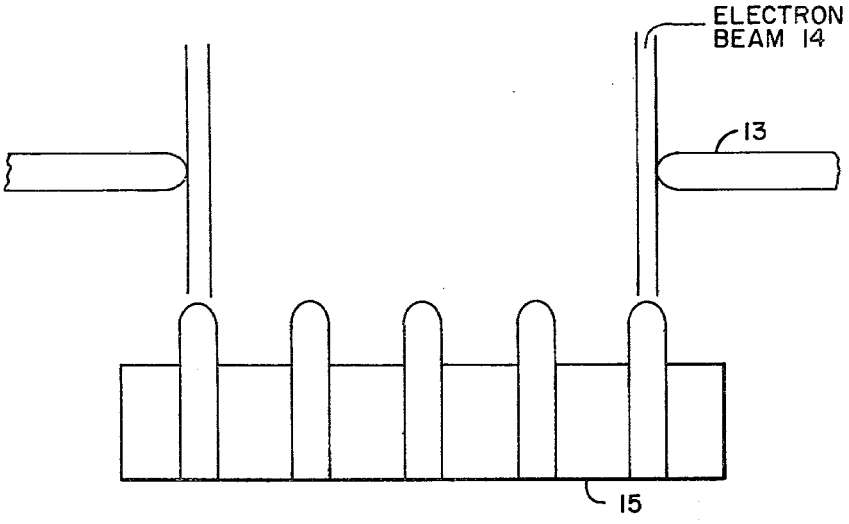
FIG. 3 is an illustration of a basic embodiment of the present invention.
Figure 4:
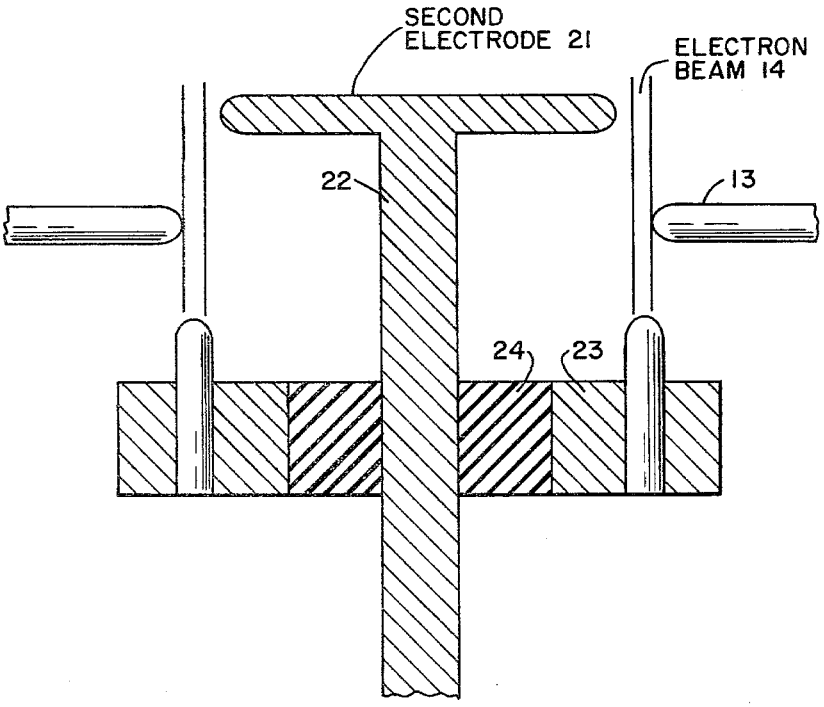
FIG. 4 is another embodiment of the present invention.

The devices described in FIGS. 2–4 do not depend on the physical dimensions of a hollow emitter for the beam thickness. The diameter of the beam is determined by the diameter of the emitter and the beam thickness is determined by material composition and electrode design. This can be readily seen by considering FIG. 2 which shows a part of a cold field emitter 6 and anode 7 in a diode configuration.

It has been shown both theoretically and experimentally that the electric field distribution across the disk shaped field emitter 6 is very non-uniform when a voltage is applied across the emitter 6 and disk shaped anode 7, and that the electric field at the outer circumference points in much greater than at the inner points. That is, the electric field at points 1 and 5 is much greater than the electric field at inside points 2, 3 and 4 for a given applied voltage. This will result in electron emission from points 1 and 5 with no emission from points 2, 3 and 4 at the proper applied voltage. Thus for a round cold cathode field emitter with $10^7$ emitting sites in each square centimeter (such as disclosed in U.S. Pat. No. 3,745,402) a circular or hollow beam of electrons can be achieved with a beam thickness of approximately 3 microns ($3\times10^{-4}$ cm).

One configuration for the improved hollow beam electron source is shown in FIG. 3. In this configuration the anode consists of a metal plate 13 with a circular hole in the center through which the hollow beam of electrons 14 passes after being emitted by the field emitter 15. If required, additional focusing or beam forming electrodes can be added as necessary. Another possible configuration is shown in FIG. 4 which consists of using a second disk shaped electrode 21 which has its support 22 and electrical connection passed through the emitter 24 and is insulated from the emitter by means of a sleeve 24. Numerous other combinations are possible using electric, magnetic and a combination of the two to achieve the proper beam diameter. In FIG. 4, the second electrode 21 is spaced such that it cannot initiate emission but assists in shaping the electron beam only.

The operation of the device is as follows:

(1) The electric field is connected on the emitting points along the outer edge of the field emitter, as shown in FIG. 2, and occurs regardless of whether the anode or emitter is solid or fabricated in the form of a circle.

(2) The electric field concentration causes only the outer emitting points to produce electrons. The thickness of the hollow beam will be limited to the average spacing between individual emitting points.

(3) The hollow beam of electrons flow through the hole in the anode due to the focusing effect of the electric field between anode and emitter. Additional external focusing can be used as needed as done in conventional devices using hollow beams of electrons.

The advantages of the thin hollow beam of electrons is involved with the ability of an electronic circuit, such as the helix in a traveling wave tube, to add and extract energy from a moving beam of electrons. Since the electrons near the axis are shielded by the outer electrons, they degrade the performance of the device. Thus the smaller the wall thickness of the beam of electrons, the more efficient the coupling process. This reduces losses at several points and increases the overall efficiency of the device.

I claim:

1. A hollow beam electron source comprising a disk shaped field emitter; an emitting surface on said emitter which covers an entire area of one side of said emitter; an anode positioned spacially to said emitter and having a circular-shaped aperture therein positioned to the emitter such that a hollow beam electron flow will occur upon applying a predetermined potential of voltage between said emitter and said anode a further circular disc-shaped electrode positioned relative to said anode and said emitter such that it is positioned within the hollow beam emission and is farther from said emitter than said anode is from said emitter; and said further electrode is positioned such that when a predetermined voltage between said further electrode and emitter is present, emissions from the emitter will not be initiated but the hollow beam emissions initiated by the electrodes will be shaped by the potential applied to the further electrode; said emitter being a cold cathode field emitter which has over a million emitting sites in each square centimeter; and an electric field being formed by said emitter and said anode such that the field is concentrated about the outer edge of the emitter such that emitting sites towards the center of the emitter will not emit, while the sites toward the outer edge will emit.

2. A source as set forth in claim 1 wherein said emitter has an opening in the center of the disk, and further comprising a conductive support means connected through said emitter to said further electrode; and sleeve means around said conductive support means in the opening of said emitter so as to insulate said conductive support means from said emitter.

* * * * *